US010504537B2

(12) United States Patent
Sapozhnykov et al.

(10) Patent No.: US 10,504,537 B2
(45) **Date of Patent: *Dec. 10, 2019**

(54) WIND NOISE MEASUREMENT

(71) Applicant: Cirrus Logic International Semiconductor Ltd., Edinburgh (GB)

(72) Inventors: Vitaliy Sapozhnykov, Cremorne (AU); Thomas Ivan Harvey, Cremorne (AU); Robert Luke, Cremorne (AU)

(73) Assignee: Cirrus Logic, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/887,019

(22) Filed: Feb. 2, 2018

(65) Prior Publication Data

US 2019/0244627 A1 Aug. 8, 2019

(51) Int. Cl.

| | |
|---|---|
| ***G10L 21/0216*** | (2013.01) |
| ***G10L 21/0264*** | (2013.01) |
| ***H04R 3/00*** | (2006.01) |

(52) U.S. Cl.

CPC ..... *G10L 21/0216* (2013.01); *G10L 21/0264* (2013.01); *H04R 3/00* (2013.01); *H04R 2410/07* (2013.01); *H04R 2430/03* (2013.01)

(58) Field of Classification Search

CPC ..... H04R 2430/03; H04R 29/004; H04R 2410/07; H04R 2410/01; H04R 3/005; H04R 2410/05; H04R 29/00; H04R 29/007; H04R 2430/25; H04R 25/00; H04R 25/407; H04R 1/326; H04R 1/406;

(Continued)

(56) References Cited

U.S. PATENT DOCUMENTS 6,882,736 B2 4/2005 Dickel et al.
7,171,008 B2 * 1/2007 Elko ..... H04R 3/005 381/122

(Continued)

FOREIGN PATENT DOCUMENTS

JP 2011030022 A 10/2011
WO 2013091021 A1 6/2013

(Continued)

OTHER PUBLICATIONS

Sapozhnykov, V.V., "Sub-Band Detector for Wind-Induced Noise" J Sign Process Syst (2018), https://doi.org/10.1007/s11265-017-1325-8.

(Continued)

*Primary Examiner* — Lun-See Lao
(74) *Attorney, Agent, or Firm* — Jackson Walker L.L.P.

(57) ABSTRACT

A device for measuring wind noise comprises at least a first microphone and a processor. A first signal and a second signal are obtained from the at least one microphone, the first and second signals reflecting a common acoustic input, and the first and second signals being at least one of temporally distinct and spatially distinct. The first signal is processed to determine a first distribution of the samples of the first signal. The second signal is processed to determine a second distribution of the samples of the second signal. From a difference between the first distribution and the second distribution a scalar non-binary metric reflecting an intensity of wind noise present in the first and second signals is derived, and output.

34 Claims, 7 Drawing Sheets

(58) Field of Classification Search
CPC ..... H04R 2201/003; H04R 2430/21; G10L 2021/02166; G10L 21/0208; G10L 21/0216; G10L 19/022; G10L 21/034; G10L 21/0388; G10L 25/06; G10L 25/21; G10L 21/028; G10L 15/065; G10L 15/16; G10L 19/00; G10L 2015/226; G10L 21/003; G10L 21/0232
USPC ..... 381/71.1–71.4, 94.1–94, 4, 56–58; 700/94
See application file for complete search history.

(56) References Cited

U.S. PATENT DOCUMENTS 7,340,068 B2 3/2008 Petersen et al.
7,464,029 B2 * 12/2008 Visser ..... G10L 21/0272 704/210
9,906,882 B2 * 2/2018 Sapozhnykov ..... H04R 3/005
2005/0041825 A1 * 2/2005 Rasmussen ..... H04R 25/402 381/317
2012/0128163 A1 * 5/2012 Moerkebjerg ..... H04R 25/407 381/23.1
2014/0161271 A1 * 6/2014 Teranishi ..... H04R 5/04 381/71.7

FOREIGN PATENT DOCUMENTS

WO 2016011499 A1 1/2016
WO WO 2016/011499 * 1/2016 ..... H04R 3/02

OTHER PUBLICATIONS

Wilson, Keith et al:"Discrimination of Wind Noise and Sound Waves by Their Contrasting Spatial and Temporal Properties", Acta Acustica United With Acustica, vol. 96 (2010) 991-1002.
Visser, E. et al., A spatio-temporal speech enhancement scheme for robust speech recognition in noisy environments, Speech Communication 41 (2003) 393-407.

* cited by examiner

WIND NOISE MEASUREMENT

FIELD OF THE INVENTION

The present invention relates to the digital processing of signals from microphones or other such transducers, and in particular relates to a device and method for measuring the amount of wind noise or the like in such signals, for example to enable wind noise compensation or suppression to be initiated or controlled depending on the amount of wind noise present.

BACKGROUND OF THE INVENTION

Wind noise is defined herein as a microphone signal generated from turbulence in an air stream flowing past a microphone port or over a microphone membrane. This is as opposed to the sound of wind blowing past other objects distal from the microphone, such as the sound of rustling leaves as wind blows past a tree in the far field, and such distal noise sources do not comprise wind noise within the present definition.

For wearable devices, the proximity of a human body (e.g. head, torso, and/or hand) may generate additional turbulence and wind noise. Wind noise is impulsive and often has an amplitude large enough to exceed the nominal speech amplitude. Wind noise can thus be objectionable to the user and/or can mask other signals of interest. It is desirable that digital signal processing devices are configured to take steps to ameliorate the deleterious effects of wind noise upon signal quality. To do so requires a suitable means for reliably measuring wind noise when it occurs, without falsely indicating that wind noise exists to some extent when in fact other factors are affecting the signal.

Some previous approaches to wind noise detection (WND) assume that non-wind sounds are generated in the far field and thus have a similar sound pressure level (SPL) and phase at each microphone, whereas wind noise is substantially uncorrelated across microphones. However, for non-wind sounds generated in the far field, the SPL between microphones can substantially differ due to localized sound reflections, room reverberation, and/or differences in microphone coverings, obstructions, or location such as due to orthogonal plane placement of microphones on a smartphone with one looking inwards and the other looking outwards. Substantial SPL differences between microphones can also occur with non-wind sounds generated in the near field, such as a telephone handset held close to the microphones. Differences in microphone output signals can also arise due to differences in microphone sensitivity, i.e. mismatched microphones, which can be due to relaxed manufacturing tolerances for a given model of microphone, or the use of different models of microphone in a system.

The spacing between the microphones causes non-wind sounds to have different phase at each microphone sound inlet, unless the sound arrives from a direction where it reaches both microphones simultaneously. In directional microphone applications, the axis of the microphone array is usually pointed towards the desired sound source, which gives the worst-case time delay and hence the greatest phase difference between the microphones.

When the wavelength of a received sound is much greater than the spacing between microphones, i.e. at low frequencies, the microphone signals are fairly well correlated and previous WND methods might not falsely detect wind at such frequencies. However, when the received sound wavelength approaches the microphone spacing, the phase difference causes the microphone signals to become less correlated and non-wind sounds can be falsely detected as wind. The greater the microphone spacing, the lower the frequency above which non-wind sounds will be, or might be, falsely detected as wind, i.e. the greater the portion of the audible spectrum in which false detections might occur. False detection may also occur due to other causes of phase differences between microphone signals, such as localized sound reflections, room reverberation, and/or differences in microphone phase response or inlet port length. Given that the spectral content of wind noise at microphones can extend from below 100 Hz to above 10 kHz depending on factors such as the hardware configuration, the presence of a user's head or hand, and the wind speed, it is desirable for wind noise detection to operate satisfactorily throughout much if not all of the audible spectrum, so that wind noise can be detected and suitable suppression means activated only in sub bands where wind noise is problematic.

In light of the above-noted difficulties of differentiating wind noise from other signal types, to date wind noise has been addressed by coarse detection methods, being systems which simply output a binary flag indicating whether wind noise is present or absent. In such systems the binary output detection flag is then used to alter the operation of other processing modules, such as to switch wind noise reduction on or off in a binary manner. To even produce such a binary detection output is nevertheless difficult to accomplish with sufficient accuracy, due to the complexities noted above.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this specification, a statement that an element may be "at least one of" a list of options is to be understood that the element may be any one of the listed options, or may be any combination of two or more of the listed options.

SUMMARY OF THE INVENTION

According to a first aspect, the present invention provides a device for measuring wind noise, the device comprising:

- at least a first microphone; and
- a processor configured to:
  - obtain a first signal and a second signal from the at least one microphone, the first and second signals reflecting a common acoustic input, and the first and second signals being at least one of temporally distinct and spatially distinct;
  - process the first signal to determine a first distribution of the samples of the first signal;
  - process the second signal to determine a second distribution of the samples of the second signal;
  - derive from a difference between the first distribution and the second distribution a scalar non-binary metric reflecting an intensity of wind noise present in the first and second signals; and
  - output the scalar metric.

According to a second aspect, the present invention provides a non-transitory computer readable medium comprising computer program code means to make a computer execute a procedure for wind noise measurement, the computer program product comprising:

computer program code means for obtaining a first signal and a second signal from at least one microphone, the first and second signals reflecting a common acoustic input, and the first and second signals being at least one of temporally distinct and spatially distinct;

computer program code means for processing the first signal to determine a first distribution of the samples of the first signal;

computer program code means for processing the second signal to determine a second distribution of the samples of the second signal;

computer program code means for deriving from a difference between the first distribution and the second distribution a scalar non-binary metric reflecting an intensity of wind noise present in the first and second signals; and computer program code means for outputting the scalar metric.

According to a third aspect, the present invention provides a method for measuring wind noise, the method comprising:

obtaining a first signal and a second signal from at least one microphone, the first and second signals reflecting a common acoustic input, and the first and second signals being at least one of temporally distinct and spatially distinct;

processing the first signal to determine a first distribution of the samples of the first signal;

processing the second signal to determine a second distribution of the samples of the second signal;

deriving from a difference between the first distribution and the second distribution a scalar non-binary metric reflecting an intensity of wind noise present in the first and second signals; and outputting the scalar metric.

In some embodiments of the invention, the scalar metric reflecting the intensity of wind noise may be a single scalar non-binary value. The scalar metric reflecting the intensity of wind noise may, in some embodiments, be expressed as a probability between 0 and 1, reflecting a probability of the presence of wind noise.

In some embodiments of the invention, the scalar non-binary metric reflecting an intensity of wind noise comprises a plurality of measures respectively determined from distinct microphone signals. In some embodiments of the invention, at least some of the plurality of measures comprise scalar non-binary values. In some embodiments of the invention, the scalar metric reflecting the intensity of wind noise is a measure of wind noise power.

In some embodiments of the invention, there may be provided at least one wind noise measurement cell receiving microphone signals from at least two microphones, wherein the wind noise measurement cell is controllable by a control signal to measure wind noise either by (a) comparing sample distributions from two microphone signals or (b) comparing temporally spaced sample distributions from a single microphone signal. The control signal may in some embodiments be configured to exclude a particular microphone signal from the cell measurements at times when the respective microphone is occluded. In some embodiments of the invention, wind noise measures from at least two wind noise measurement cells are passed to a decision function module configured to produce a combined output measure from the individual wind noise measures.

In some embodiments of the invention, the first and second signals are made to be temporally distinct by taking temporally distinct samples of a single microphone signal. In some embodiments of the invention, the first and second signals are made to be spatially distinct by taking the first signal from a first microphone and taking the second signal from a second microphone spaced apart from the first microphone.

In some embodiments of the invention, for each sub-band of a plurality of sub-bands, a scalar non-binary metric reflecting an intensity of wind noise present in the first and second signals in that sub-band may be derived. In some embodiments of the invention, wind noise may be measured first in respect of a lower frequency sub-band, and may only measure wind noise in respect of a higher frequency sub-band if non-negligible wind noise is measured in the lower frequency sub-band. In some embodiments of the invention, wind noise reduction may be applied only in each sub-band in which the measurement of wind noise is greater than a respective sub-band threshold.

In some embodiments of the invention, the difference between the first distribution and the second distribution may be calculated and copied to more than one wind noise measurement block.

In some embodiments of the invention, the decision function module is configured to produce the combined output measure as a scalar metric from the individual wind noise measures by applying a neural network. In some embodiments of the invention, the decision function module may be configured to produce the combined output measure as a scalar metric from the individual wind noise measures by applying a hidden Markov model. In some embodiments of the invention, the decision function module is configured to produce the combined output measure as a binary metric from the individual wind noise measures by applying a truth table.

In some embodiments of the invention, the device may be a telephony headset or handset, a still camera, a video camera, a tablet computer, a cochlear implant or a hearing aid.

In some embodiments, the decision function module is configured to produce the combined output measure as a scalar metric from the individual wind noise measures by applying one or more of: averaging, weighted sums, maxima, minima, or a combination thereof.

In some embodiments, each microphone signal is matched for amplitude so that an expected variance of each signal is the same or approximately the same. In some embodiments, the first and second microphone signals are matched for an acoustic signal of interest such as speech before the wind noise measurement is performed.

In some embodiments, the distribution of each of the first and second signals comprises a cumulative distribution of signal sample magnitude. In some embodiments, the distribution of each of the first and second signals is determined only at one or more selected values. In some embodiments, calculating the difference between the first distribution and the second distribution is performed by calculating the point-wise difference between the first and second distribution at each selected value, and summing the absolute values of the point-wise differences to produce a measure of the difference between the first distribution and the second distribution.

In some embodiments, the or each microphone signal is high pass filtered to remove any DC component. In some embodiments, the wind noise measurement is performed on a frame-by-frame basis by comparing the distribution of samples from a single frame of each signal. In some embodiments, the difference between the first distribution and the second distribution is smoothed over multiple frames.

BRIEF DESCRIPTION OF THE DRAWINGS

An example of the invention will now be described with reference to the accompanying drawings, in which.

Corresponding reference characters indicate corresponding components throughout the drawings.

DETAILED DESCRIPTION OF PREFERRED EMBODIMENTS

Figure 1A:
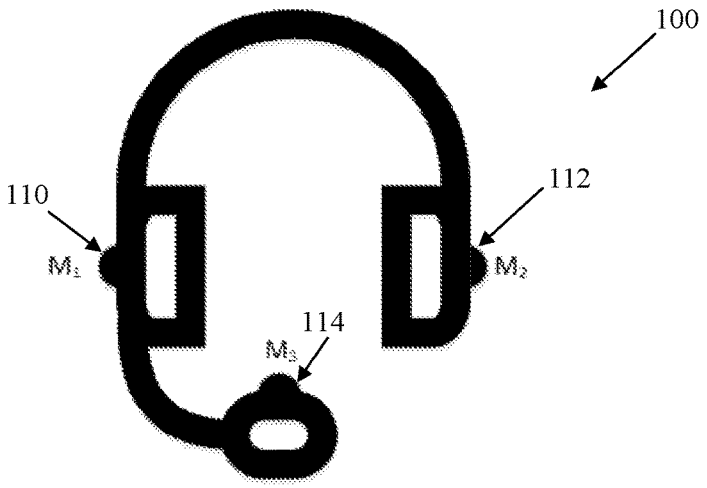
FIGS. 1*a* and 1*b* depict a headset for deploying a wind noise measurement module in accordance with one embodiment of the invention.

FIG. 1*a* shows a 3-microphone headset 100 which deploys a wind noise measurement (WNM) module in accordance with one embodiment of the invention. Other devices which may implement wind noise measurement in accordance with other embodiments of the invention include headsets whether wired or wireless, smartphones, tablet computers, digital cameras, and audio capture devices. In the embodiment of FIG. 1 the headset 100 has three microphones, namely microphone 110 or $M_1$ on the exterior of a right earcup of the headset 100, microphone 111 or $M_2$ on the exterior of a left earcup of the headset 100, and microphone 114 or $M_3$ on a boom of the headset 100. Other embodiments may provide for wind noise measurement to be applied to devices having an alternative number of microphones, including devices having a single microphone, or two or more microphones. Each microphone, $M_1$, $M_2$, and $M_3$ captures a respective acoustic signal and transforms it to a corresponding electrical signal. The microphone signals could be used for telephony, audio recordings, or the like. Alternative embodiments may take other form factors, such as a headset having earcups without a boom, a single earpiece with a boom, earbuds with a wired pendant, wireless earbuds, and the like.

The signals from each microphone can however each be independently impacted by wind noise arising from wind passing the respective microphone port and in the immediate vicinity of each respective microphone.

Figure 1B:
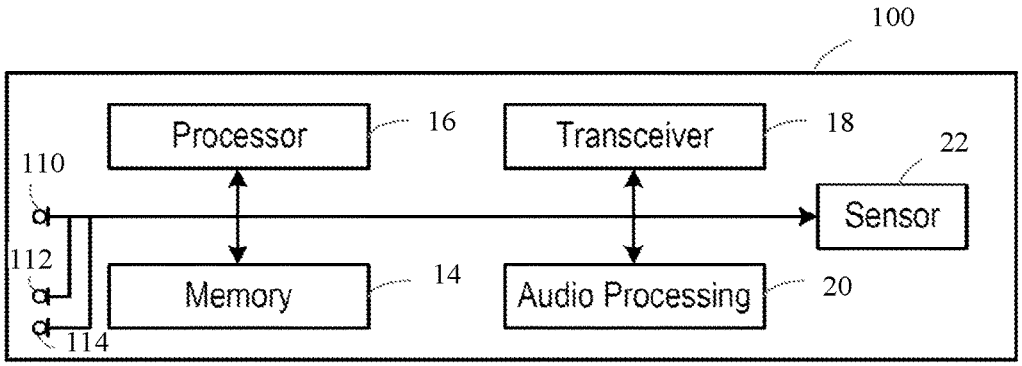

FIG. 1*b* is a schematic diagram, illustrating the form of the headset 100. Specifically, FIG. 1*b* shows various interconnected components of the headset 100. It will be appreciated that the headset 100 may in practice contain many other components, but the following description is sufficient for an understanding of the present invention. Thus, FIG. 1*b* shows the microphones 110, 112, 114.

FIG. 1*b* also shows a memory 14, which may in practice be provided as a single component or as multiple components. The memory 14 is provided for storing data and program instructions. FIG. 1*b* also shows a processor 16, which again may in practice be provided as a single component or as multiple components. For example, one component of the processor 16 may be an applications processor of the headset 100.

FIG. 1*b* also shows a transceiver 18, which is provided for allowing the headset 100 to communicate with external devices such as a smartphone. For example, the transceiver 18 may include circuitry for establishing a Bluetooth connection. FIG. 1*b* also shows audio processing circuitry 20, for performing operations on the audio signals detected by the microphones.

Figure 2:
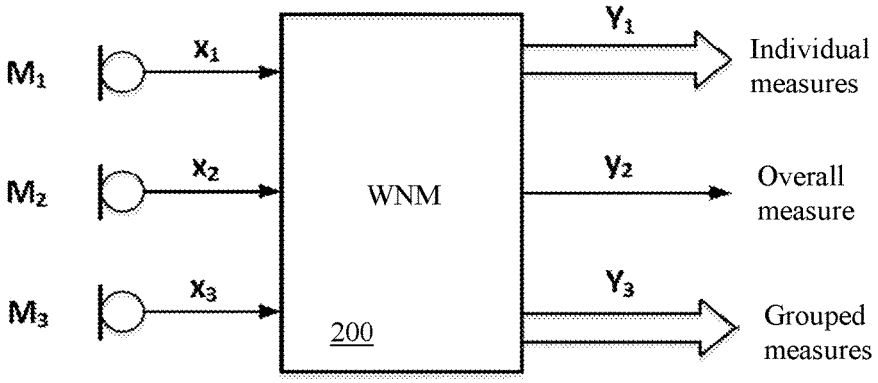
FIG. 2 is a generalised block diagram of a wind noise measurement module implemented upon the headset of FIG. 1.

FIG. 2 shows a generalised block diagram of the proposed wind noise measurement (WNM) module 200 implemented upon headset 100. The purpose of the WNM module 200 is to analyse the microphone signals $x_1$, $x_2$ and $x_3$ from microphones $M_1$-$M_3$ respectively, so as to determine to what extent wind noise is affecting the signal(s), and the WNM module 200 produces an output which comprises (a) one or more individual wind noise measurements $Y_1$, being scalar non-binary metrics reflecting an intensity of wind noise in the microphone signal(s) as calculated by individual wind noise measurement blocks within WNM 200, (b) an overall decision yz being a scalar non-binary metric reflecting an intensity of wind noise as calculated from all noise measurement blocks within WNM 200, and (c) one or more grouped measures $Y_3$ being scalar non-binary metrics reflecting an intensity of wind noise as calculated from subsets of the noise measurement blocks within WNM 200.

In general, in accordance with the invention, the wind noise measurement output comprises at least one scalar metric, or a collection of binary metrics and/or scalar metrics which collectively constitute a non-binary output, to thereby indicate a severity or intensity of wind noise observed in the microphone signals. In this embodiment this analysis is performed on a sub-band basis, whereby for each sub-band the WNM 200 produces an output of at least one scalar non-binary metric, or a collection of binary and/or scalar metrics which collectively constitute a non-binary output, which indicates an intensity of wind noise observed in the microphone signals in that particular sub-band. The "per-sub-band" wind intensity metrics are output for example for use by a wind noise reduction (WNR) module configured to apply any suitable technique to reduce wind noise in affected sub-bands while attempting to preserve the target signal (e.g. speech), responsive to the observed severity of wind noise. Any suitable wind noise reduction technique may be applied.

Figure 3:
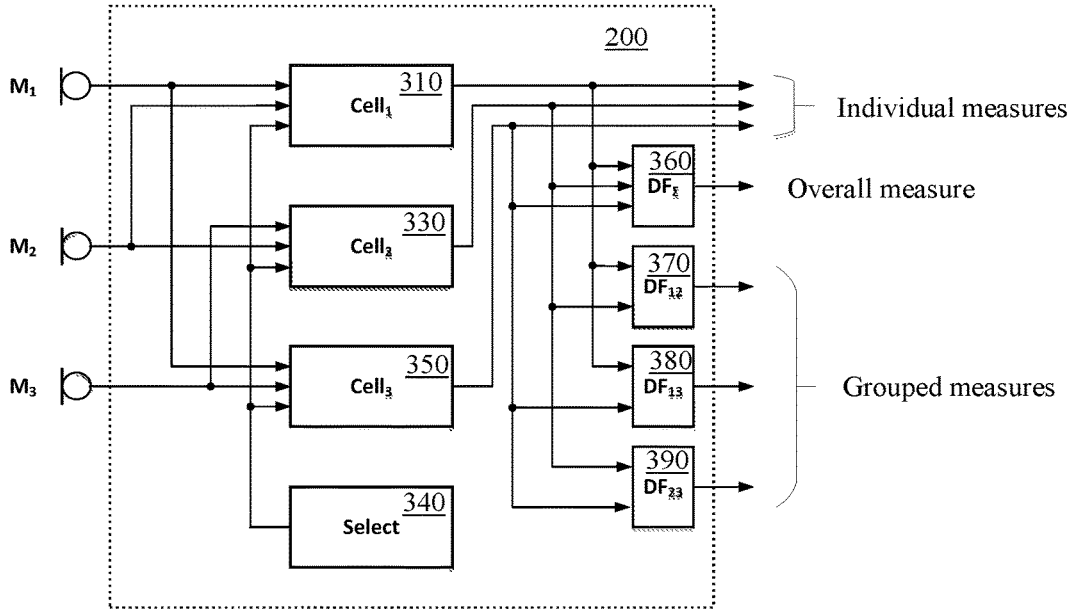
FIG. 3 is a more detailed block diagram of the WNM module of FIG. 2.

FIG. 3 is a more detailed block diagram of the WNM module 200 of FIG. 2. The wind noise measurement module 200 is input with digitised input frames of signals $x_1$, $x_2$, and $x_3$ from microphones $M_1$, $M_2$, and $M_3$ respectively. The wind noise measurement module 200 processes the input signals $x_1$, $x_2$, and $x_3$ and outputs a collective wind intensity measure comprising measures Y1, y2, and Y3, where a capital letter designates a vector, and a lower case letter designates a scalar. The vector $Y_1$ contains 3 individual wind presence decisions (one for each microphone, $M_1$, $M_2$, and $M_3$), such that $Y_1=\{y_1^1,y_2^1,y_3^1\}$, where $y_i^1$, i=1.3 is an individual wind presence indicator for the i-th microphone, being the outputs of Cells 1-3, 310, 330 and 350.

The scalar yz is a combined overall wind presence indicator which in this embodiment is produced by a decision function block $DF_\Sigma$ 360, by OR-ing the individual decisions $y_1^1$, $y_2^1$, and $y_3^1$. In alternative embodiments, the individual decisions may be AND-ed, or any other method of aggregating the individual decisions into a single indicator yz may be used.

The vector Y3 contains grouped aggregations of individual wind presence indicators such that $Y_3=\{y_{12}^3,y_{13}^3,y_{23}^3\}$, where $y_{ij}^3$, i=1.3, j=1.3, i≠j, $y_{ij}^3=y_{ji}^3$ is an aggregated wind presence indicator produced by combining individual wind presence indicator for the i-th and j-th microphone respectively, this being accomplished by blocks $DF_{12}$ 370, $DF_{13}$ 380 and $DF_{23}$ 390. In this embodiment, each individual grouped aggregated wind presence indicator, $y_{ij}^3$, is produced by the respective blocks $DF_{12}$ 370, $DF_{13}$ 380 and $DF_{23}$ 390 by OR-ing the individual decisions $y_i^1$, $y_j^1$ from cells 310, 330, 350. In alternative embodiments, the individual decisions from cells 310, 330, 350 may be AND-ed by the respective blocks $DF_{12}$ 370, $DF_{13}$ 380 and $DF_{23}$ 390, or any other method of aggregating the individual decisions into a single indicator yz may be used.

It is to be noted that, while the embodiment of FIG. 3 makes "hard" binary decisions to combine the individual decisions $y_i^1$, $y_j^1$ from cells 310, 330, 350 into a corresponding aggregate decision, alternative embodiments may produce "soft" (non-binary) wind noise measurement features from any or all of the blocks 310, 330, 350, 360, 370, 380 and 390. Any or all such soft non-binary measures may be thresholded to output binary measures Y1, y2, and Y3, which collectively make up the wind intensity measure output by WNM 200. However, in particularly advantageous embodiments, some or all soft non-binary measures output by the blocks 310, 330, 350, 360, 370, 380 and 390 may be output without thresholding, as "soft" metrics. Advantageous embodiments may output each such soft metric within the range of 0 to 1 in order to represent a probability of wind presence, rather than a "hard" binary wind presence indicator.

Addressing FIG. 3 in more detail, it is noted that electrical signals from microphones $M_1$, $M_2$, and $M_3$ are input into corresponding Cells 310, 330, 350, where individual wind presence indicators are calculated. Each Cell 310, 330, 350 has three inputs: two inputs for microphone signals and one control input from Select module 340. $Cell_1$ 310 is input with electrical signals from the microphones $M_1$ and $M_2$, $Cell_2$ 330 is input with electrical signals from the microphones $M_2$ and $M_3$, and $Cell_3$ 350 is input with electrical signals from the microphones $M_1$ and $M_3$ thus spanning all non-repeatable combinations of microphones, $M_i$.

Each Cell 310, 330, 350 is also input with an individual control signal, control, from Select module 340. The control signal is used to switch between single- and multi-microphone wind noise measurement schemes. The Select module 340 may be configured such that individual control signals are changed in real time in response to changing environmental or situational conditions. For example, at times one or more of the microphones n may be blocked or obstructed or occluded such as by dirt or the user's hand, with the result that electrical signal $x_i$ generated by the microphone $M_i$ is severely attenuated or distorted, and therefore features of electrical signal $x_i$ generated by $M_i$ used for wind presence decision become unreliable. Detecting blocked mics may be performed by any suitable method, including but not limited to the teachings of U.S. Provisional Patent Application No. 62/529,295 by the present Applicant.

In response to detection of a blocked microphone, or detection of any other circumstance requiring exclusion of a given microphone signal, the Select module 340 generates a control signal which configures the $Cell_i$ such that it would only use electrical signal $x_{i+1}$ from an unobstructed microphone, $M_{i+1}$, as discussed further in the following with reference to FIGS. 4, 8 and 10.

In the WNM 200 of FIG. 3, individual wind presence indicators (Individual Decisions) output by cells 310, 330, 350 are passed to the output of the wind noise measurement module, WNM, as they are. Also, all these Individual Decisions are passed to block 360 where they are combined into a single aggregate Overall Decision in the Decision Fusion module, $DF_\Sigma$. The Individual Decisions output by cells 310, 330, 350 are also passed to blocks 370, 380, 390 where they are grouped into a set of Grouped Decisions in corresponding Decision Fusion modules, $DF_{ij}$, so as to span all non-repeatable microphone combinations, or in other combinations as required.

By outputting a whole suite of WNM indications comprising the individual measures $Y_1$, the overall measure $y_2$, and the grouped measures $Y_3$, other modules in the device can use the set of outputs $Y_1$, $y_2$, and $Y_3$ in any unique manner suitable for that particular module. This is particularly important as the WNM module 200 acts as something of a "master switch" in relation to a number of other signal processing stages of the device, and thus has the significant responsibility of activating, deactivating, or substantially modifying the operation of a number of other processing functions. The present invention thus recognises that a single binary wind noise "detection" output is inappropriately coarse and that outputting multiple binary indicators $Y_1$, $y_2$, and $Y_3$, or one or more soft WNM indicators, enables the powerful system-wide effect of the WNM module to be more accurately applied throughout the remainder of the signal processing functions of the device.

For example, some modules should be deactivated or should pause adaption very quickly in response to the onset of even very small amounts of wind noise, in cases where the operation or adaption of such modules is easily and quickly corrupted by wind noise. In contrast, other modules should be activated in response to the onset of wind noise only once there is a great degree of certainty that wind noise is present in the signal. The present invention thus recognises that a single binary detection output is inappropriately coarse and fails to meet the respective unique and diverse requirements of multiple diverse other processing functions. The present invention recognises that instead outputting a wind noise measure comprising multiple binary indicators, or one or more soft non-binary metrics, enables the powerful system-wide effect of the WNM module 200 to be more accurately applied on a case-by-case basis throughout the remainder of the signal processing functions of the device.

Figure 4A:
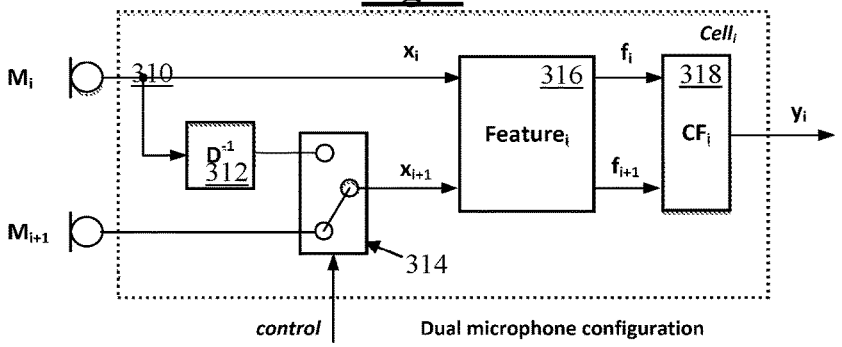
FIGS. 4*a* and 4*b* are block diagrams of an individual measurement cell of the WNM module, with FIG. 4*a* showing the cell configured in Dual Microphone mode, and FIG. 4*b* showing the cell configured in Single Microphone mode.
Figure 4B:
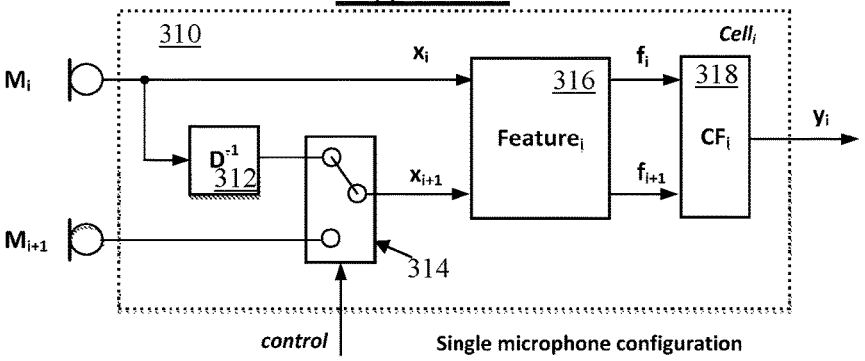

FIGS. 4*a* and 4*b* are block diagrams of the cell 310 of WNM module 200. FIG. 4*a* shows cell 310 configured in Dual Microphone mode, as controlled by select module 340, while FIG. 4*b* shows cell 310 configured in Single Microphone mode, as controlled by select module 340. Cell 310 receives digitised signals $x_1$ and $x_2$, denoted generically as $x_i$ and $x_{i+1}$, as Cells 330 and 350 take a corresponding form as cell 310 and are thus not separately described.

The digitised signals $x_1$ and $x_2$ are input into the feature calculation modules of block 316, $\text{Feature}_i$ and $\text{Feature}_{i+1}$ respectively, where signal features, $f_i$ and $f_{i+1}$, used for measurement of wind in the input signals, are calculated. The features $f_i$ and $f_{i+1}$ are fed from block 316 to the Criterion Function module 318, $CF_i$ where a final decision about wind noise presence in the signals $x_i$ and $x_{i+1}$ is made. The Criterion Function module 318 implements a criterion function Q(*) which combines features into a single scalar $y_i$ so that:

$$y_i = Q(f_i, f_{i+1})$$

Thus, in the Dual Microphone configuration of FIG. 4*a*, the scalar $y_i$ indicates the probability or intensity of wind induced noise in the input signals $x_i$ and $x_{i+1}$. The scalar $y_i$ therefore also indicates the intensity of wind at the microphones $M_i$ and $M_{i+1}$, if any.

In the case of the Dual Microphone configuration of FIG. 4*a*, the control signal from Select module 340 configures the $\text{Cell}_i$ 310 by setting switch 314 so that the input electrical signals $x_i$ and $x_{i+1}$ to block 316 comprise one signal from each corresponding microphone, $M_i$ and $M_{i+1}$ respectively. Therefore feature $f_i$ is calculated based on the input signal $x_i$ from the microphone $M_i$, and similarly, feature $f_{i+1}$ is calculated based on the input signal $x_{i+1}$ from the microphone $M_{i+1}$.

On the other hand, when a Single Microphone configuration is used as depicted in FIG. 4*b*, the control signal from the Select module 340 configures the $\text{Cell}_i$ 310 by setting switch 314 so that only the signal from the microphone $M_i$ is used to calculate both features, $f_i$ and Signal $f_{i+1}$, which is used to calculate feature $f_{i+1}$, is a signal observed at the microphone $M_i$ at a previous analysis interval (i.e. delayed in $D^{-1}$ module 312 which in this embodiment implements a single frame delay). Therefore, wind presence indicator $y_i$ is calculated based on temporally distinct (and spatially indistinct) signal frames, being the current frame and previous frame from a single microphone, $M_i$. This is in contrast to dual microphone configuration of FIG. 4*a* in which the wind presence indicator $y_i$ is calculated based on spatially distinct frames (observed contemporaneously) on each microphone, $M_i$ and $M_{i+1}$.

Thus, in Single Microphone configuration, the scalar $y_i$ indicates an intensity of wind noise in the input signal $x_i$, but conveys nothing about wind noise in the input signal $x_{i+1}$. Similarly, in single microphone configuration the scalar $y_i$ indicates intensity of wind at the microphone $M_i$, but conveys nothing about the intensity of wind at the microphone $M_{i+1}$.

In the embodiment of FIG. 4 each Cell 310, 330, 350 requires a dedicated memory to store framed samples from each microphone $M_i$ and $M_{i+1}$. For example, if frame interval is 2 ms and system sampling frequency is 48000 Hz, then the Cell has to have 2×96=192 words of memory to store $x_i$ and $x_{i+1}$ observed at the previous frame interval.

Figure 5A:
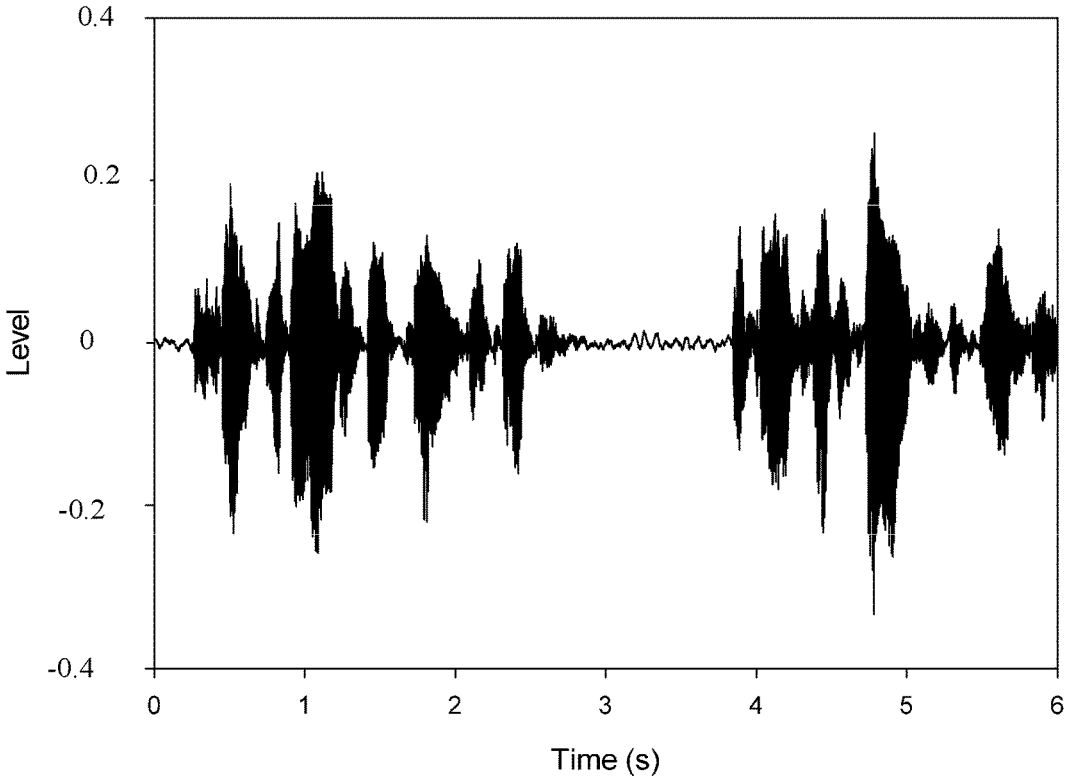
FIG. 5*a* illustrates a typical speech signal, unaffected by wind noise.
Figure 5B:
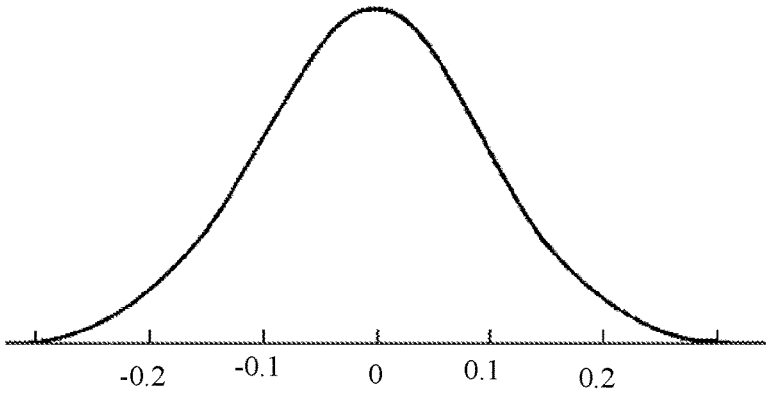
FIG. 5*b* illustrates the distribution of signal sample magnitudes in the signal of FIG. 5*a*.
Figure 5C:
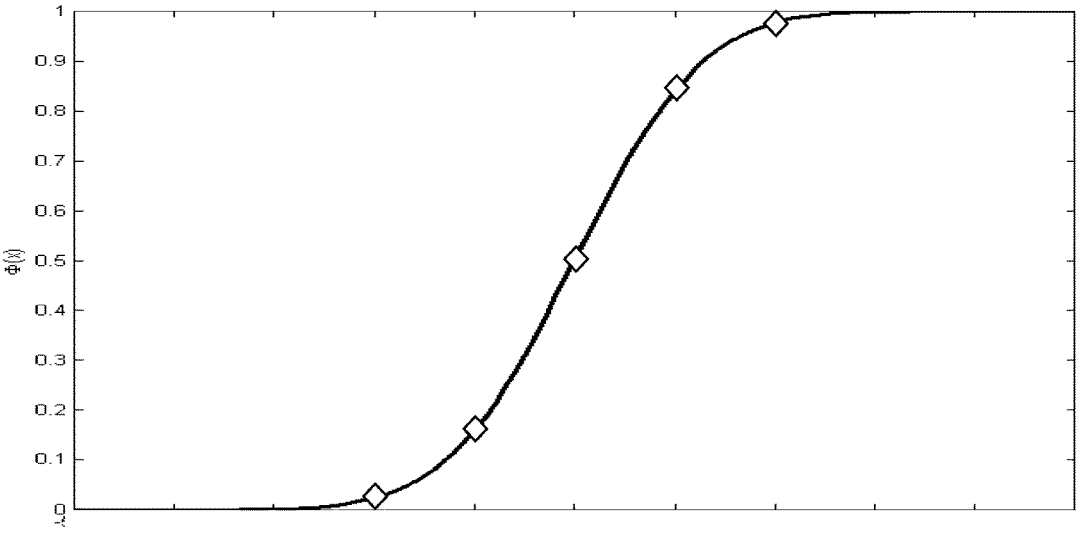
FIG. 5*c* illustrates the cumulative distribution of signal sample magnitudes in the signal of FIG. 5*a;*

In this embodiment, empirical distribution functions (EDF) of signals $x_i$ and $x_{i+1}$ are used as the features $f_i$ and $f_{i+1}$, and the criterion function Q(*) was the mean absolute difference between $f_i$ and $f_{i+1}$ quantised to a single bit: 0 (wind not present) and 1 (wind present) via a predefined threshold or a combination of thresholds (e.g. if Schmitt trigger is used). To explain the nature of the EDF features we consider FIG. 5*a* which illustrates a typical speech signal, unaffected by wind noise. As can be seen, and as illustrated in FIG. 5*b* the distribution of signal sample magnitudes in the signal of FIG. 5*a* is a normal distribution about zero. FIG. 5*c* illustrates the cumulative distribution of signal sample magnitudes in the signal of FIG. 5*a*.

Figure 6:
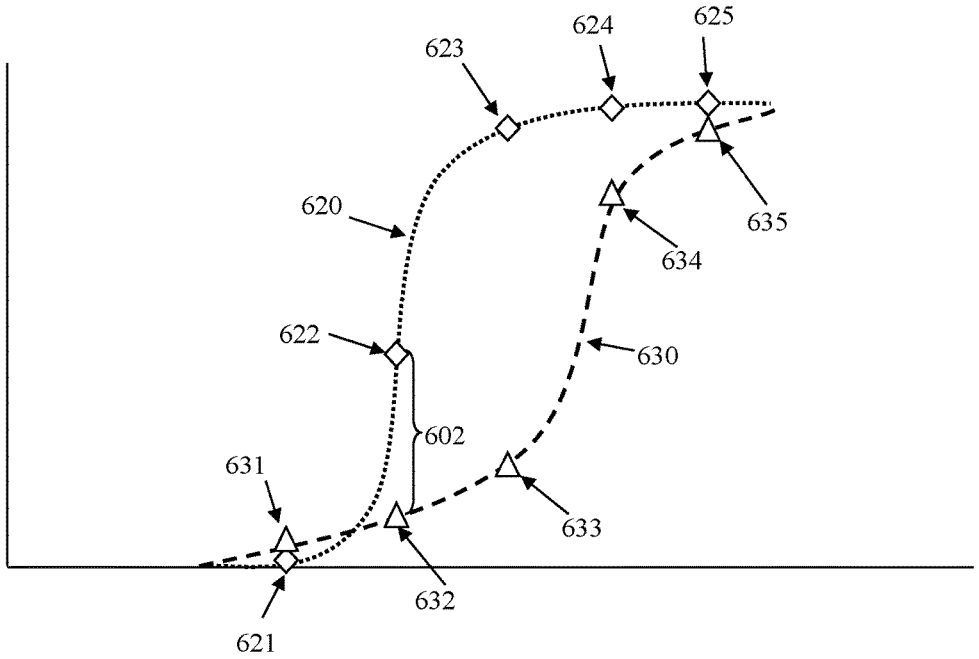
FIG. 6 illustrates cumulative distributions of first and second signal input signals when affected by wind noise.

However, the use of EDFs in the present invention recognises that EDFs are affected by wind noise in the input signal(s). FIG. 6 illustrates how the cumulative distributions 620, 630 of first and second signal input electrical signals $x_i$ and $x_{i+1}$ might appear when affected by wind noise. It is noted that the distributions 620, 630 in FIG. 6 are shown as dotted lines, because only selected points on each distribution need to be determined in order to put the present embodiment of the invention into effect, and the precise curve need not be determined over its full length at other values. In the present embodiment, five selected values of each distribution 620, 630 are determined, namely the respective cumulative distribution values at points 621-625 on curve 620, and the respective cumulative distribution values at points 631-635 on curve 630. Then, the absolute value of the differences between the distributions at those values are determined, with one of these five difference values, between the value at 622 and the value at 632, being indicated at 602. As occurs between points 621 and 622, the curves 620 and 630 may cross one or more times, and this is why the absolute values are taken of the differences. Finally, the absolute values of the differences are summed, in order to produce a scalar metric reflecting wind noise.

Figure 7:
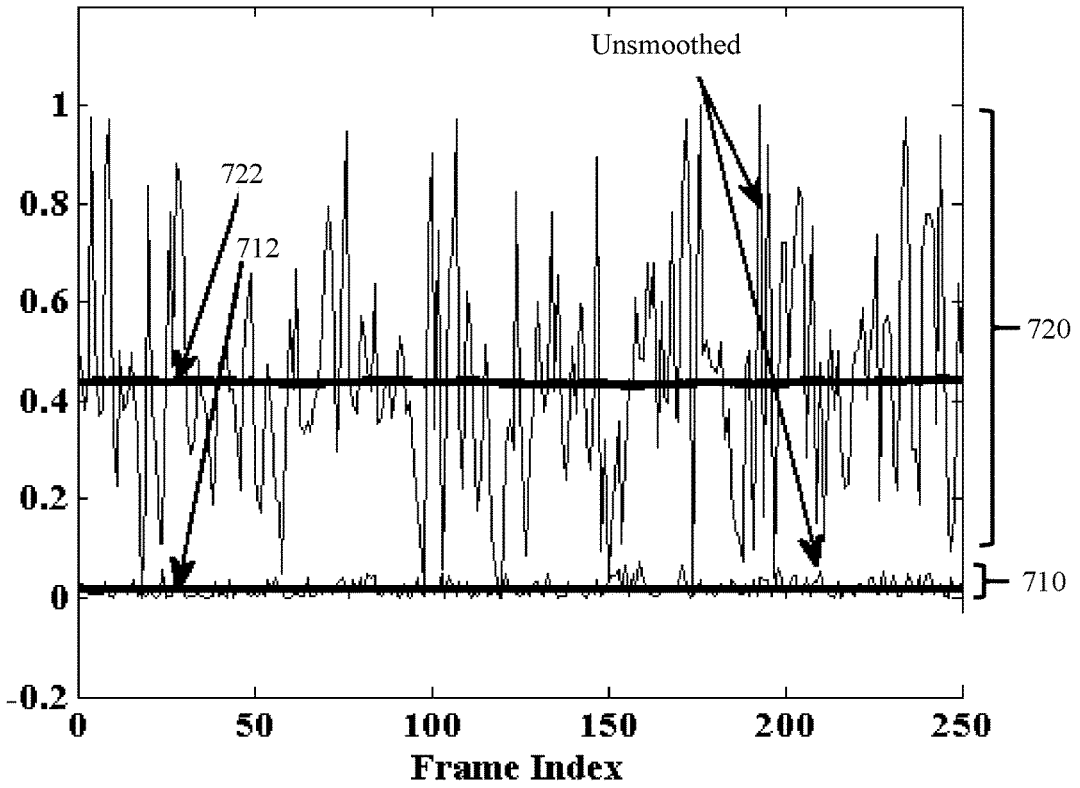
FIG. 7 shows scalar metric values produced from cumulative distributions of first and second signal input signals, over 250 frames of audio, in the presence and absence of wind noise.

FIG. 7 shows examples values of the scalar metric produced in the above-described manner, repeatedly over 250 frames of audio. Near-field speech in traffic and babble noise was used as the "substrate" audio to represent the "no wind" condition, and then wind of average velocity of 4 m/s was added to the "substrate" audio to produce the "wind present" condition. The signal was sampled at 48 kHz and arranged into 2 millisecond-long frames (96 samples each); 250 frames (0.5 second) of metrics were calculated, and are shown. In the absence of wind the unsmoothed metric has a very small dynamic range 710, and takes a smoothed value 712 which is very close to zero. In the presence of even such a moderate wind as 4 m/s passing the microphones, the 30 metric takes a much larger dynamic range 720 and a smoothed value 722 which is significantly different from zero. The present invention recognises that a suitably smoothed metric such as that shown in FIG. 7 can provide not only a binary detection of the presence or absence of wind noise, but can be configured to provide a qualitative measure of the intensity of wind noise affecting the microphone signal(s).

Alternative embodiments may calculate the difference between cumulative distribution functions 620 and 630 in any suitable manner, such as by using a smaller or larger number of points or by characterising the respective distribution and then comparing the extracted characteristics to each other. Other embodiments may also omit normalisation of the result and/or may normalise the result to any suitable scale. Smoothing of the metric is desirable due to the wide variability visible in the unsmoothed results of FIG. 7, and smoothing may be performed in any suitable manner such as by a leaky integrator or averaging process, and may be applied over any suitable time period or time constant to effect a desired degree of smoothing.

Figure 8A:
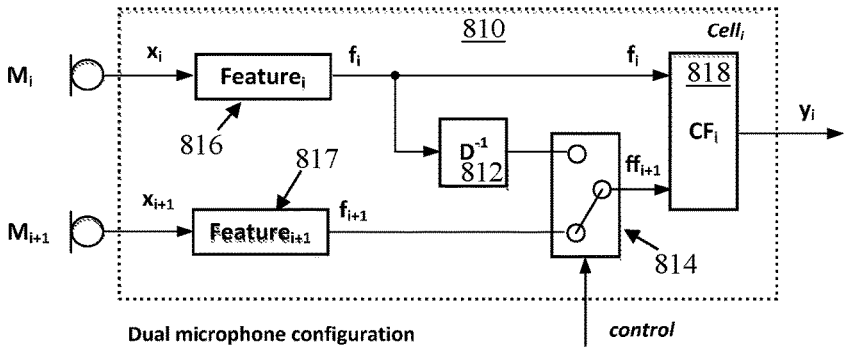
FIGS. 8*a* and 8*b* which are block diagrams of another implementation of the i-th Cell in a Dual Microphone and Single Microphone configuration respectively.
Figure 8B:
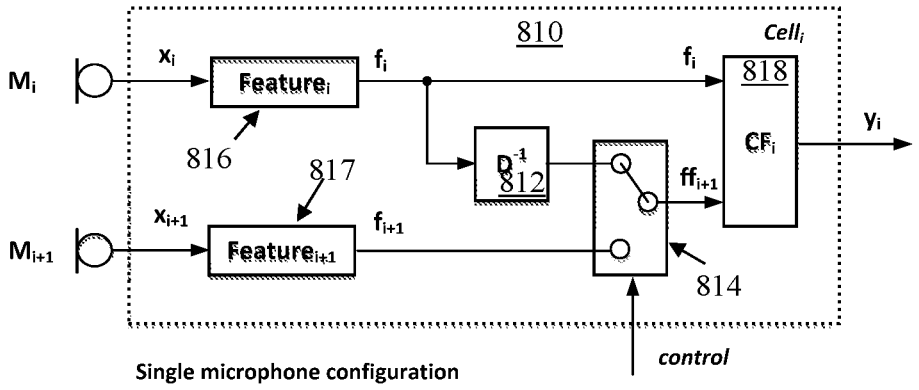

With the above-described approach to determining the individual metrics, we turn now to FIGS. 8*a* and 8*b* which are block diagrams of another implementation of the i-th Cell 810 in a Dual Microphone and Single Microphone configuration respectively. Similarly to the implementation of Cell 310 described previously in relation to FIG. 4, electrical signals $x_i$ and $x_{i+1}$ are input into the feature calculation modules, Feature$_i$ 816 and Feature$_{i+1}$ 817 respectively, where signal features, $f_i$ and $f_{i+1}$, used for measurement of wind in the input signal(s), are calculated as described above. The features $f_i$ and $f_{i+1}$ are fed into the Criterion Function module, CF$_i$ 818, where the individual wind measure $y_i$ is produced.

In both Dual and Single Microphone configurations (FIG. 8*a* and FIG. 8*b*), for each signal the feature $f_i$ is calculated based on the input signal $x_i$ observed at the microphone $M_i$, and similarly, feature $f_{i+1}$ is calculated based on the input signal $x_{i+1}$ observed at the microphone $M_{i+1}$.

In the Dual Microphone configuration (FIG. 8*a*), the control signal from the Select module 340 configures the Cell$_i$ 810 by setting the switch 814 so that the calculated features $f_i$ and $ff_{i+1}$, where $ff_{i+1}=f_{i+1}$, are fed into the Criterion Function module, CF$_i$ 818.

In the Single Microphone configuration (FIG. 8*b*), the control signal from the Select module 340 configures the Cell$_i$ 810 by setting switch 814 so that the calculated features $f_i$ and $ff_{i+1}$, where $ff_{i+1}=f_i$, at a previous analysis interval (i.e. feature $f_i$ delayed in $D^{-1}$ module 812 which implements a single frame delay), are fed into the Criterion Function module, CF$_i$ 818. In the setting of FIG. 8*b*, the individual wind measure $y_i$ is calculated based on time-adjacent features (current and previous) extracted from the same electrical signal $x_i$ from the i-th microphone $M_i$. It should be noted, that each Cell 810 requires dedicated memory which stores features extracted from framed samples observed at each corresponding microphone $M_i$ and $M_{i+1}$. For example, if each feature consists of N components (such as 5 components as shown in FIG. 6), then the Cell has to have 2×N words of memory to store $f_i$ and $f_{i+1}$ observed at the previous frame interval. However this is likely to be considerably less than the memory requirements of FIG. 3, thus offering memory efficiency.

As noted for FIG. 4, in the Dual Microphone configuration of FIG. 8*a* the scalar $y_i$ is an individual measure of wind induced noise in the input signals $x_i$ and $x_{i+1}$, and therefore also indicates the amount of wind at the microphones $M_i$ and $M_{i+1}$. On the other hand, in Single Microphone configuration of FIG. 8*b*, the scalar $y_i$ is an individual measure of wind noise in the input signal $x_i$ only, but conveys nothing about wind noise in the input signal $x_{i+1}$, and therefore also indicates the amount of wind at the microphone $M_i$ only.

Figure 9:
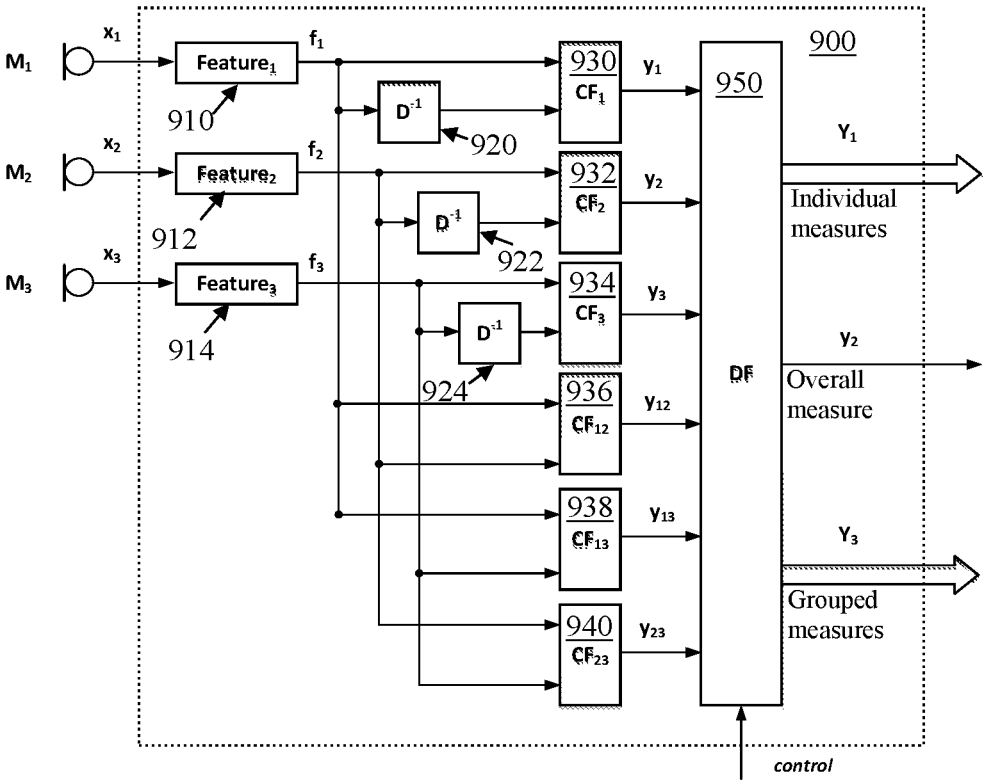
FIG. 9 is a block diagram of a wind noise measurement module in accordance with another embodiment of the invention.

FIG. 9 is a block diagram of a wind noise measurement module 900 in accordance with another embodiment of the invention. Electrical signals, $x_1$, $x_2$, and $x_3$ generated by corresponding microphones $M_1$, $M_2$, and $M_3$ are fed into the Feature modules, Feature$_1$ 910, Feature$_2$ 912, and Feature$_3$ 914, which produce respective features $f_1$, $f_2$, and $f_3$ in the manner described in relation to FIG. 6. As mentioned, EDF of the microphone signals, and mean absolute difference between features quantised to a single bit may be used as features and criterion function respectively, however other features and decision criteria are possible.

The calculated features, $f_1$, $f_2$, and $f_3$ are fed from 910, 912, 914, respectively, into a set of criterion functions, CF$_1$ 930, CF$_2$ 932 and CF$_3$ 934, together with a respective delayed copy of the features, $f_1$, $f_2$, and $f_3$ provided via delay blocks 920, 922, 924. Criterion function modules CF$_1$ 930, CF$_2$ 932 and CF$_3$ 934 calculate individual (single microphone) wind measures $y_1$, $y_2$, and $y_3$ from features $f_1$, $f_2$, and $f_3$, respectively.

The features, $f_1$, $f_2$, and $f_3$ are also fed from 910, 912, 914, respectively into a set of criterion function modules CF$_{12}$ 936, CF$_{13}$ 938 and CF$_{23}$ 940, so that pairwise dual microphone wind presence measures $y_{12}$, $y_{13}$, and $y_{23}$ are calculated from each pair combination of features $f_1$, $f_2$, and $f_3$ respectively.

While not shown in FIG. 9, other embodiments may employ more complex criterion functions for more than two inputs (features), such that:

$$y_{i,i+1,\ldots,L}=Q(f_i,f_{i+1},\ldots,f_L)$$

where L>2 is the total number of features taking part in the decision; L depends on the number of microphones and allowed wind noise measurement complexity.

In the WNM 900 of FIG. 9 it is to be noted that features, $f_1$, $f_2$, and $f_3$ are each calculated only once and are then copied into four downstream blocks. For example $f_1$ is copied to CF$_1$ 930, $D^{-1}$ 920, CF$_{12}$ 936 and CF$_{13}$ 938. Thus, features, $f_1$, $f_2$, and $f_3$ are calculated only once and do not need to be repetitively calculated in each such downstream block, improving computational efficiency of this architecture.

Individual (single mic) measures $y_1$, $y_2$, $y_3$, and pairwise (dual mic) measures $y_{12}$, $y_{13}$, and $y_{23}$ are then passed to the multiple-input multiple output (MIMO) Decision Fusion module, DF 950. The Decision Fusion module outputs the Individual Measures (single mic) $Y_1$, the Overall Measure $y_2$ and the Grouped Measures (dual mics) $Y_3$, as described previously. The DF module 950 may be implemented as a neural network, hidden Markov model (HMM) or any other appropriate algorithm for generating scalar non-binary measures, or as a MIMO Truth Table or any other appropriate algorithm in alternative embodiments where one or more of the measures $Y_1$, $y_2$ and $Y_3$ are binary decisions.

In each the described embodiments, with regard to the Decision Function, in the case of a two microphone wind noise measurement module two single channel wind noise blocks, and one two channel noise block can be instantiated. The output of the two channel block should increase if wind is present on either microphone. The output of the single channel block should increase if wind is present on that single microphone. If the two channel block goes high without either single channel block going high then this is likely to be a false fire, and it is to be noted that the decision block can protect against this false fire by only setting the output high (or biasing it higher) if the two channel block is high AND either of the single channel blocks are high. Similar logic can be applied in the decision block of the single channel wind noise measurement modules, the output can only go high (or be biased higher) if the single channel block is high AND the two channel block is high.

Other examples of methods to combined "soft" wind presence decisions, which may be utilised in the DF block in other embodiments of the invention, include:

a. Averaging:

$$d_{out}=\frac{1}{N}\sum_{n=1}^{N}d_n,$$

where N is the number of "soft" decisions b. Weighted sum:

$$d_{out}=\frac{1}{N}\sum_{n=1}^{N}w_n d_n,$$

where w is a corresponding weight c. Maximum: $d_{out}=\max\{d_1, d_2, \ldots, d_N\}$ d. Minimum: $d_{out}=\min\{d_1, d_2, \ldots, d_N\}$ e. A combination of any or all of the above.

Figure 10:
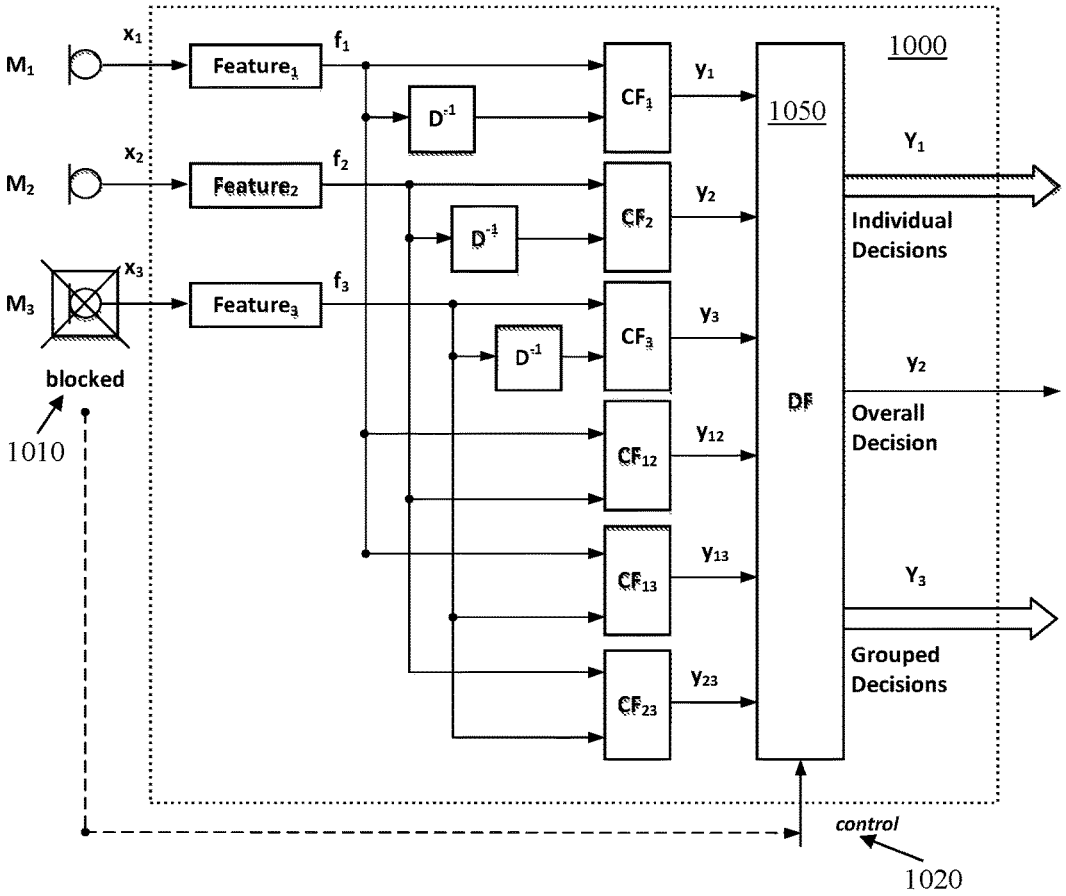
FIG. 10 is a block diagram of a wind noise measurement module in accordance with yet another embodiment of the invention.

FIG. 10 is a block diagram of a wind noise measurement module 1000 in accordance with still another embodiment of the invention. Like elements correspond to FIG. 9 and are not described further. However, the WNM 1000 further provides blocked microphone detection. Detecting blocked microphones is performed on each microphone signal by the method of U.S. Provisional Patent Application No. 62/529,295 by the present Applicant. When the blocked microphone detector indicates that a microphone is blocked, as depicted at 1010, a control signal is produced at 1020 and input to the DF module 1050. This enables DF module to exclude microphone M3 from wind noise measurement determinations for so long as it is blocked.

A further advantage provided by embodiments of the invention outputting a scalar non-binary wind noise measure, is that use of a single threshold may result in rapid and repeated switching of a binary output from ON to OFF and back to ON again, many times in quick succession, even when smoothed. Use of a soft output enables some hysteresis to be introduced so that an OFF to ON threshold can differ from an ON to OFF threshold, on a module by module basis, so that when the WNM indication is hovering around one such threshold it will not cause inappropriately fluctuating responses in each downstream module.

While in FIGS. 9 and 10 3-microphone configurations are portrayed, the proposed wind noise measurement module can be easily expanded to any arbitrary number of microphones.

It is noted that wind noise energy tends to be concentrated at the low portion of the spectrum; and with increased wind velocity the wind noise occupies progressively more and more bandwidth. As wind noise energy for many wind noise situations is thus mainly located at low frequencies, a significant portion of the speech spectrum remains relatively unaffected by wind noise. Therefore in order to preserve the naturalness of the processed audio signal by not modifying the unaffected bands, some embodiments of the present invention recognise that wind-noise reduction techniques which attempt to reduce wind noise energy while preserving signal (e.g. speech) energy, should be applied selectively only to the portion of spectrum which is affected by wind noise. Thus the "wind noise-free" parts of the speech signal spectrum will not be unnecessarily modified by the system. Hence, this selective reduction of wind noise requires an improved measurement metric which can indicate a severity of wind noise in particular spectral sub-bands. Accordingly, it is to be understood that the techniques described herein for full band wind noise measurement can similarly be applied on a sub-band basis, whereby sub-band microphone signals are created by use of appropriate time domain bandpass filters and wind noise detection is applied in each sub band.

In the described embodiments each microphone signal can be matched for amplitude so that an expected variance of each signal is the same or approximately the same. The microphone signals can also be matched for an acoustic signal of interest before the wind noise measurement is performed.

In some embodiments, while the microphone signals are captured by the headset 100, the microphone signals and/or features may be transmitted using the transceiver 18 to a remote system such as a smartphone or a remote system located on one or more remote servers in a cloud computing environment, for computation of one or more parts of the described wind noise measurement. Signals based on the determinations of the remote system may then be returned to the headset 100 or an associated smartphone or other local device for further action.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A device for measuring wind noise, the device comprising:

at least two microphones; and a processor configured to:

based on a control signal, obtain a first signal and a second signal from the at least two microphones, the first and second signals reflecting a common acoustic input, and the first and second signals being selected, in response to the control signal, to be either first and second temporally distinct signals each obtained from the same one of the at least two microphones, or first and second spatially distinct signals obtained from two of the at least two microphones;

process the first signal to determine a first distribution of the samples of the first signal;

process the second signal to determine a second distribution of the samples of the second signal;

derive from a difference between the first distribution and the second distribution a scalar non-binary metric reflecting an intensity of wind noise present in the first and second signals; and output the scalar metric.

2. The device of claim 1 wherein the scalar metric reflecting the intensity of wind noise is a single scalar non-binary value.

3. The device of claim 2 wherein the scalar metric reflecting the intensity of wind noise is expressed as a probability between 0 and 1, reflecting a probability of the presence of wind noise.

4. The device of claim 1 wherein the scalar non-binary metric reflecting an intensity of wind noise comprises a plurality of measures respectively determined from distinct microphone signals.

5. The device of claim 4 wherein at least some of the plurality of measures comprise scalar non-binary values.

6. The device of claim 1 wherein the scalar metric reflecting the intensity of wind noise is a measure of wind noise power.

7. The device of claim 1, wherein the processor is configured to execute at least one wind noise measurement cell configured to perform the steps of obtaining the first signal and the second signal, processing the first signal, processing the second signal, and deriving the difference between the first distribution and the second distribution.

8. The device of claim 7 wherein the control signal is configured to exclude a particular microphone signal from the cell measurements at times when the respective microphone is occluded.

9. The device of claim 7 wherein wind noise measures from at least two wind noise measurement cells are passed to a decision function module configured to produce a combined output measure from the individual wind noise measures.

10. The device of claim 1 wherein the first and second signals are made to be temporally distinct by taking temporally distinct samples of a single microphone signal.

11. The device of claim 1 wherein the first and second signals are made to be spatially distinct by taking the first signal from a first microphone and taking the second signal from a second microphone spaced apart from the first microphone.

12. The device of claim 1 configured to derive, for each sub-band of a plurality of sub-bands, a scalar non-binary metric reflecting an intensity of wind noise present in the first and second signals in that sub-band.

13. The device of claim 12 configured to measure wind noise first in respect of a lower frequency sub-band, and to only measure wind noise in respect of a higher frequency sub-band if non-negligible wind noise is measured in the lower frequency sub-band.

14. The device of claim 12, further configured to apply wind noise reduction only in each sub-band in which the measurement of wind noise is greater than a respective sub-band threshold.

15. The device of claim 1, configured to calculate the difference between the first distribution and the second distribution and to copy the output of the calculation to more than one wind noise measurement block.

16. The device of claim 9 wherein the decision function module is configured to produce the combined output measure as a scalar metric from the individual wind noise measures by applying a neural network.

17. The device of claim 9 wherein the decision function module is configured to produce the combined output measure as a scalar metric from the individual wind noise measures by applying a hidden Markov model.

18. The device of claim 9 wherein the decision function module is configured to produce the combined output measure as a binary metric from the individual wind noise measures by applying a truth table.

19. The device of claim 1, comprising at least one of a telephony headset or handset, a still camera, a video camera, a tablet computer, a cochlear implant or a hearing aid.

20. A non-transitory computer readable medium comprising computer program code means to make a computer execute a procedure for wind noise measurement, the computer program product comprising:

computer program code means for, based on a control signal, obtaining a first signal and a second signal from at least two microphones, the first and second signals reflecting a common acoustic input, and the first and second signals being selected, in response to the control signal, to be either first and second temporally distinct signals each obtained from the same one of the at least two microphones, or first and second spatially distinct signals obtained from two of the at least two microphones;

computer program code means for processing the first signal to determine a first distribution of the samples of the first signal;

computer program code means for processing the second signal to determine a second distribution of the samples of the second signal;

computer program code means for deriving from a difference between the first distribution and the second distribution a scalar non-binary metric reflecting an intensity of wind noise present in the first and second signals; and computer program code means for outputting the scalar metric.

21. A method for measuring wind noise, the method comprising:

based on a control signal, obtaining a first signal and a second signal from at least two microphones, the first and second signals reflecting a common acoustic input, and the first and second signals being selected, in response to the control signal, to be either first and second temporally distinct signals obtained from the same one of the at least two microphones, or first and second spatially distinct signals obtained from two of the at least two microphones;

processing the first signal to determine a first distribution of the samples of the first signal;

processing the second signal to determine a second distribution of the samples of the second signal;

deriving from a difference between the first distribution and the second distribution a scalar non-binary metric reflecting an intensity of wind noise present in the first and second signals; and outputting the scalar metric.

22. The method of claim 21 wherein the scalar metric reflecting the intensity of wind noise is a single scalar non-binary value.

23. The method of claim 22 wherein the scalar metric reflecting the intensity of wind noise is expressed as a probability between 0 and 1, reflecting a probability of the presence of wind noise.

24. The method of claim 21 wherein the scalar non-binary metric reflecting an intensity of wind noise comprises a plurality of measures respectively determined from distinct microphone signals.

25. The method of claim 24 wherein at least some of the plurality of measures comprise scalar non-binary values.

26. The method of claim 21 wherein the scalar metric reflecting the intensity of wind noise is a measure of wind noise power.

27. The method of claim 21, wherein the steps of obtaining the first signal and the second signal, processing the first signal, processing the second signal, and deriving the difference between the first distribution and the second distribution are performed by at least one wind noise measurement cell.

28. The method of claim 27 wherein the controlling is configured to exclude a particular microphone signal from the cell measurements at times when the respective microphone is occluded.

29. The method of claim 27 comprising passing wind noise measures from at least two wind noise measurement cells to a decision function module, and the decision function module producing a combined output measure from the individual wind noise measures.

30. The method of claim 21 configured to derive, for each sub-band of a plurality of sub-bands, a scalar non-binary metric reflecting an intensity of wind noise present in the first and second signals in that sub-band.

31. The method of claim 21, comprising calculating the difference between the first distribution and the second distribution and copying the output of the calculation to more than one wind noise measurement block.

32. The method of claim 29 wherein producing the combined output measure as a scalar metric from the individual wind noise measures comprises applying a neural network.

33. The method of claim 29 wherein producing the combined output measure as a scalar metric from the individual wind noise measures comprises applying a hidden Markov model.

34. The method of claim 29 wherein producing the combined output measure as a binary metric from the individual wind noise measures comprises applying a truth table.

* * * * *